US009964302B2

(12) United States Patent
Lindstrom et al.

(10) Patent No.: US 9,964,302 B2
(45) Date of Patent: May 8, 2018

(54) FUEL INJECTION SYSTEM FOR USE IN A CATALYTIC HEATER AND REACTOR FOR OPERATING CATALYTIC COMBUSTION OF LIQUID FUELS

(71) Applicant: REFORMTECH HEATING HOLDING AB, Kista (SE)

(72) Inventors: Bard Lindstrom, Johanneshov (SE); Daniel Hagstrom, Stocksund (SE)

(73) Assignee: REFORMTECH HEATING HOLDING AB, Kista (SE)

( * ) Notice: Subject to any disclaimer, the term of this patent is extended or adjusted under 35 U.S.C. 154(b) by 356 days.

(21) Appl. No.: 14/400,831

(22) PCT Filed: May 14, 2013

(86) PCT No.: PCT/SE2013/050534
§ 371 (c)(1),
(2) Date: Nov. 13, 2014

(87) PCT Pub. No.: WO2013/172770
PCT Pub. Date: Nov. 21, 2013

(65) Prior Publication Data

US 2015/0204540 A1 Jul. 23, 2015

(30) Foreign Application Priority Data

May 15, 2012 (SE) ..... 1250495

(51) Int. Cl.
*F23C 13/02* (2006.01)
*F23D 11/44* (2006.01)
*F23C 13/06* (2006.01)

(52) U.S. Cl.
CPC ..... *F23C 13/02* (2013.01); *F23C 13/06* (2013.01); *F23D 11/44* (2013.01); *F23D 11/446* (2013.01); *F23D 2900/21002* (2013.01)

(58) Field of Classification Search
CPC ..... F23C 13/02; F23C 13/06
(Continued)

(56) References Cited

U.S. PATENT DOCUMENTS 5,158,448 A 10/1992 Kawasaki et al.
5,395,235 A * 3/1995 Lan-Sun Hung ..... F23C 13/02 431/328

(Continued)

FOREIGN PATENT DOCUMENTS

DE 4230686 3/1994
DE 102008001815 11/2009

(Continued)

OTHER PUBLICATIONS

Extended European search report, dated Dec. 17, 2015; Application No. 13790273.0.

(Continued)

*Primary Examiner* — Avinash Savani
*Assistant Examiner* — Aaron Heyamoto
(74) *Attorney, Agent, or Firm* — Young & Thompson

(57) ABSTRACT

The present invention relates to a system for utilizing liquid fuels, such as diesel and gasoline, in a catalytic reactor for producing clean heat from the fuel. In particular it relates to a fuel injection system for a catalytic burner (310, 313). It includes preheating elements (308', 309, 315; FT) for preheating the catalytic burner (310, 313) and primary fuel supply elements (307) for supplying fuel to the catalytic burner (310, 313). The preheating elements (308', 309, 315; FT) and the primary fuel supply elements (307) are provided in separate compartments (310, 312), the compartments being connected with each other via a channel (CH).

11 Claims, 3 Drawing Sheets

(58) Field of Classification Search
USPC ..... 431/237, 170, 236; 60/723, 722
See application file for complete search history.

(56) References Cited

U.S. PATENT DOCUMENTS

| | | | | |
|---|---|---|---|---|
| 6,223,537 | B1 | 5/2001 | Lipinski | |
| 2003/0126863 | A1 | 7/2003 | Critchley | |
| 2004/0255588 | A1* | 12/2004 | Lundberg | F23C 13/02 60/723 |
| 2010/0139599 | A1 | 6/2010 | Vestin | |

FOREIGN PATENT DOCUMENTS

| | | | |
|---|---|---|---|
| JP | H06-2850 | A | 1/1994 |
| JP | H09-243078 | A | 9/1997 |
| JP | 2003-003865 | A | 1/2003 |
| JP | 2004-515741 | A | 5/2004 |
| JP | 2005-344989 | A | 12/2005 |
| JP | 2006-017437 | A | 1/2006 |
| JP | 2006-234279 | A | 9/2006 |
| JP | 2010-513835 | A | 4/2010 |
| JP | 2010-276331 | A | 12/2010 |
| SE | 530775 | | 9/2008 |
| WO | 03072919 | | 9/2003 |
| WO | 03102407 | | 12/2003 |
| WO | 2008/076838 | A2 | 6/2008 |

OTHER PUBLICATIONS

International Search Report dated Sep. 12, 2013, corresponding to PCT/SE2013/050534.

* cited by examiner

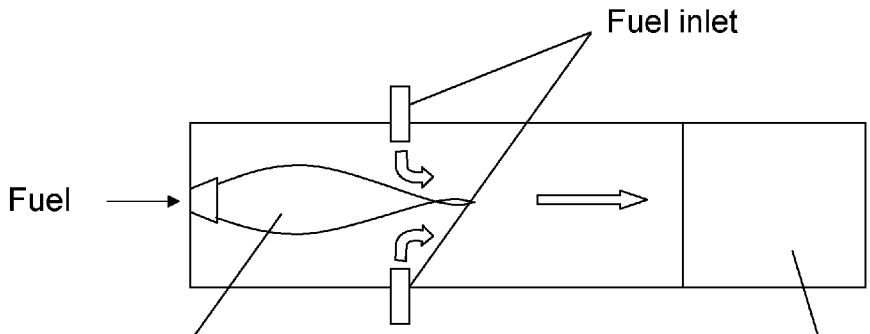
Fig. 2a (PRIOR ART)
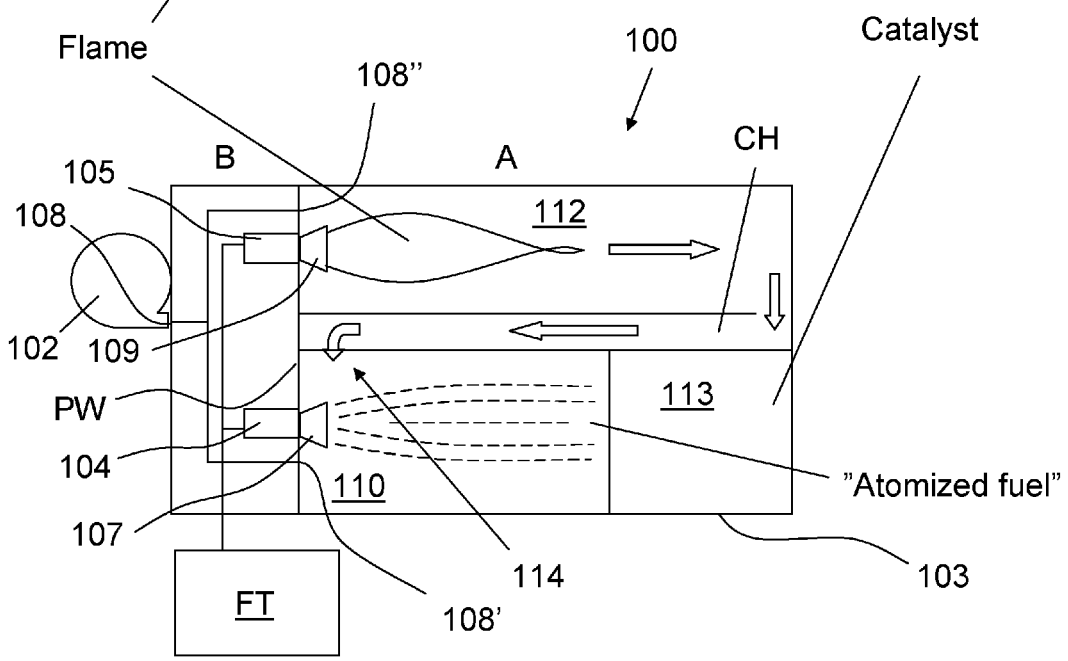
Fig. 2b (INVENTION)

FUEL INJECTION SYSTEM FOR USE IN A CATALYTIC HEATER AND REACTOR FOR OPERATING CATALYTIC COMBUSTION OF LIQUID FUELS

The present invention relates to a system for utilizing liquid fuels, such as diesel and gasoline, in a catalytic reactor for producing clean heat from the said fuel.

BACKGROUND

Conventional fuel fired heaters utilizes flame combustion for producing heat, a process that is associated with the generation of both particles (soot, ash) and chemical emissions (CO, NOx) that are all harmful to the environment.

By replacing the flame combustion system with a catalytic oxidation system it is possible to eliminate fuel related emissions and at the same time increase the efficiency of the process by lowering the temperature of the oxidation process (through increased air flow). A primary feature of catalytic oxidation is that the process is not limited to a low air-to-fuel ratio, which results in complete oxidation of all hydrocarbons and lower temperatures in the reaction zone to a level at which NOx production is hindered.

A major challenge with a catalytic heater operating on a multi component liquid fuel, such as diesel or gasoline, is to start the heater in a cold environment without producing soot that can poison the catalyst, reduce the operating life of the heater and increase service cost for the end users.

The problems associated with starting-up a liquid fuel catalytic combustor has resulted in an industrial focus on gaseous fuels, such as natural gas and propane, for practical applications of catalytic combustion, as seen in U.S. Pat. No. 6,223,537, where natural gas is used to fuel the combustor.

SUMMARY OF THE INVENTION

While the concept of catalytic combustion is not new, the present invention describes a novel method for using a diesel/gasoline type fuel in a catalytic heater that prevents the formation of soot in the catalytic reactor and decreases the starting time of the heater.

Therefore, the object of the invention is to solve the problems associated with starting a catalytic combustor and using a liquid fuel in a catalytic combustor.

Thus, the inventors have devised a catalytic reactor system.

The reactor according to the invention is a compact catalytic combustor system for use in, but not limited to, applications as compartment heaters in heavy duty trucks, passenger cars, boats and residential housing where clean heat is required to meet customer and legislative requirements.

In particular a dual reaction chamber solution has been developed in which the primary start-up section is separated from the catalytic reaction zone to prevent soot contamination of the catalyst during start-up as well as to shield the catalyst from thermal shock during cold start of the system, in particular the start-up or pre-heating section is provided in a separate compartment, connected to the reaction section via a channel.

The reactor system is also constructed with a primary and secondary fuel nozzle in the reactor, operating at a common pressure allowing the system to operate at wide variable fuel power during start-up and normal operation—allowing for optimal fuel flow in both the start-up sequence and during normal operation of the catalytic heater.

The air is supplied to the reactor both for cooling components in the system, as well as for pre-heating the air before transporting the air to the catalytic reactor zone in the heater, allowing for thermal stabilization of the fuel evaporation process in the catalytic reactor and prevention of thermal aging of the catalyst due to fuel evaporation on the catalyst surface.

BRIEF DESCRIPTION OF THE DRAWINGS

FIG. 2*a* schematically illustrates the a prior art catalytic reactor;

FIG. 2*b* schematically illustrates the novel concept; and

DETAILED DESCRIPTION

For the purpose of this application, the following terms will have the indicated meanings "Multi component fuel" is a commercially available fuel, such as diesel and gasoline that is a mixture of different hydrocarbons with varying boiling points, carbon-chain lengths and structure.

The use of these commonly available commercial fuels has been limited in catalytic combustion systems as it is complicated to completely evaporate the heavy components of the fuels without producing coke, through pyrolysis, from the lighter components in the fuel as well as the production of soot during light-off of the catalyst at low temperatures.

Figure 1:
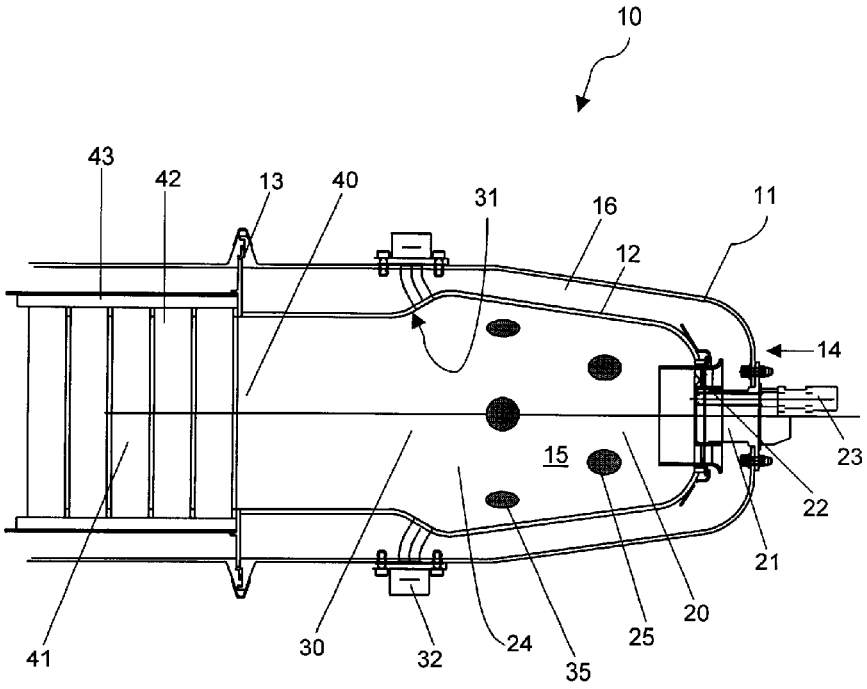
Fig. 1 (PRIOR ART)
FIG. 1 shows a prior art system.

Referring to the drawings, in FIG. 1 a prior art system (according to U.S. Pat. No. 6,223,537 is disclosed. It comprises a combustor 10 which has a generally double-walled, can-shaped configuration. The combustor 10 includes a combustor can 11, an inner liner 12 and an upstream end 14. The combustor can 11 surrounds the inner liner 12, and the inner liner 12 surrounds the chamber 15. The combustor can 11 and inner liner 12 do not contact one another but rather define a channel 16 through which air from a compressor section (not shown) flows before entering the chamber 15. In the embodiment shown in the drawings, the inner liner 12 is supported within the combustor can 11 by a perforated flange 13. The inner liner 12 may also be supportably attached to fuel nozzles 32, preferably in a loose-fitting manner to allow for thermal expansion.

Moving sequentially downstream, the combustor 10 includes a premix duct 30, a catalyst inlet 40, and a catalyst bed 41. In the embodiment shown in the drawings, at its downstream end, the inner liner 12 is approximately adjacent the upstream end of the catalyst bed 41, and the supporting structure for the catalyst bed 41 is engaged by the flange 13 for coaxial alignment with the inner liner 12. The catalyst bed 41 opens into a turbine section (not shown), which typically includes a turbine inlet and turbine wheel (not shown). In an alternative embodiment, the catalyst bed 41 is not in coaxial alignment with the inner liner 12, but is angled with respect to the axis of the inner liner 12 as may be appropriate for a given application.

The preheater 20 is a type of diffusion-flame burner that is of conventional construction, utilizing at least one preheater fuel nozzle 21 surrounded by one or more air swirlers 22 that serve to introduce air and stabilize the flame when the combustor is operating in a preheater mode. In the best mode of practicing the present invention, a single preheater fuel nozzle is used and is positioned parallel to an axis of the combustor, extending from the upstream end 14, and has its outlet surrounded by an axial air swirler. When liquid fuel is used, the at least one preheater fuel nozzle is preferably of the pressure or airblast type. The preheater also includes an igniter 23 for igniting the air and fuel that is to be combusted. In alternative embodiments, spark plugs, glow plugs, torches or other means for igniting a diffusion flame burner are employed in place of the igniter 23.

Catalytic combustion is possible only when the combustor inlet temperature exceeds a minimum value that is a function of the catalyst formulation. This is typically about 700 F. Thus the preheater is required for engine starting and for accelerating the engine to the speed necessary to obtain an adequate combustor inlet temperature. Once this condition has been reached, the preheater can be shut off. At this point a separate fuel delivery system 32 is used to introduce fuel into the premix duct 30, where the fuel is evaporated (if liquid rather than gaseous fuel is used) and mixed with the incoming air. The resulting fuel-air mixture is then introduced into the catalyst bed 41.

The combustor 10 also includes a plurality of primary air orifices 25 and a plurality of secondary air orifices 35 in the inner liner 12 downstream of the preheater fuel nozzle 21 and air swirlers 22. The primary air orifices 25 introduce additional air into the preheater 20 to enhance combustion in the preheater mode of operation. In a preferred embodiment, there are six primary air orifices circumferentially spaced around the inner liner 12. The air entering the preheater 20 through the primary air orifices 25 further stabilizes the flame by recirculating towards the preheater fuel nozzle 21, while also diluting the reacting fuel-air mixture to a level appropriate for relatively low NOx and soot production.

Downstream of the primary air orifices 25, a plurality of secondary air orifices 35 further reduces the reaction temperature and provides mixing of the fuel-air charge. It is desirable that the temperature reduction and the mixing of the fuel-air charge are sufficient to prevent damage to the catalyst and to minimize wear on the catalyst during preheater operation. In a preferred embodiment, there are twelve secondary air orifices spaced circumferentially around the inner liner 12, and the secondary orifices have a generally racetrack shape with the longer dimension oriented parallel to the axis of the inner liner 12.

As pointed out in U.S. Pat. No. 6,223,537 it is important to prevent damage to the catalyst. However, with the design shown in FIG. 1 it is virtually impossible to avoid that soot will be deposited inside the inner liner 12 at the catalyst inlet 40, and to some extent also in the catalyst 41. Therefore, the inventors devised the present invention that now will be described with reference to FIG. 2

In FIGS. 2*a* and 2*b* a schematic illustration is given of the prior art device and of the invention, respectively.

Thus, as can be seen in FIG. 2*a* there is provided only one fuel nozzle that is used for providing an initial flame so as to pre-heat the system, and separate fuel nozzles for feeding fuel once the pre-heating flame is shut off. The pre-heating nozzle is arranged in-line with the catalyst.

In FIG. 2*b* an embodiment of the present system is shown schematically. Here there is provided a pre-heating chamber 112 separated from the catalytic reaction chamber, and in particular the pre-heating chamber is arranged in thermal contact with the reaction chamber. The hot gases during pre-heating are fed to the reaction chamber via a turbulator arranged as an inlet to the reaction chamber.

Thus, a catalytic reactor system is shown schematically and generally designated with reference 100.

It comprises a reactor housing 103, preferably made of steel. The reactor housing is subdivided in two main compartments A, B, one reactor compartment A in which the reactions take place and which in turn is subdivided in three sub-compartments 110, 112, 113 (to be described) and one control compartment B housing valves and other control devices.

The reaction compartment A comprises a pre-heating chamber 112, a mixing reactor chamber 110, and a catalyst 113 which forms its own compartment by virtue of its own inherent structural constitution. The catalyst is preferably of the honeycomb type, and can be metallic or ceramic.

The control compartment B is separated from the reactor compartment A by a partition wall PW. The control compartment communicates with the reactor compartment via at least one orifice 108 through which air can be supplied to the pre-heating chamber 112 via nozzles 108', 108". For supplying the air there is provided an air delivery means, such as a fan or a compressor 102, connected to the control compartment, suitably attached directly to the reactor housing, although it could be a separate unit connected to the reactor via pipes or tubes.

Inside the control compartment B there are provided valves. A primary fuel valve 104 is provided for supplying fuel to the mixing reactor chamber 110, and a secondary valve 105 is provided for supplying fuel to the pre-heating chamber 112. Both valves are connected to the same fuel delivery means (not shown) via tubes or pipes, the fuel delivery means suitably being a pump, which in turn is connected to a fuel tank FT. Each fuel valve is provided with a respective nozzle 107, 109 for atomizing the fuel and inject the atomized fuel in the respective chamber. Although only one fuel valve is shown for each chamber, it is of course possible within the inventive idea to provide a plurality of nozzles.

In order to provide proper mixing inside the mixing reactor chamber 110 there is provided a channel CH for passing the gaseous mixture from the pre-heating chamber 112 to a turbulator 114 (only indicated). The turbulator can simply be an opening, aperture or orifice, or a plurality of openings/apertures/orifices forming an abrupt deflection of the gaseous flow, which creates turbulence.

Figure 3:
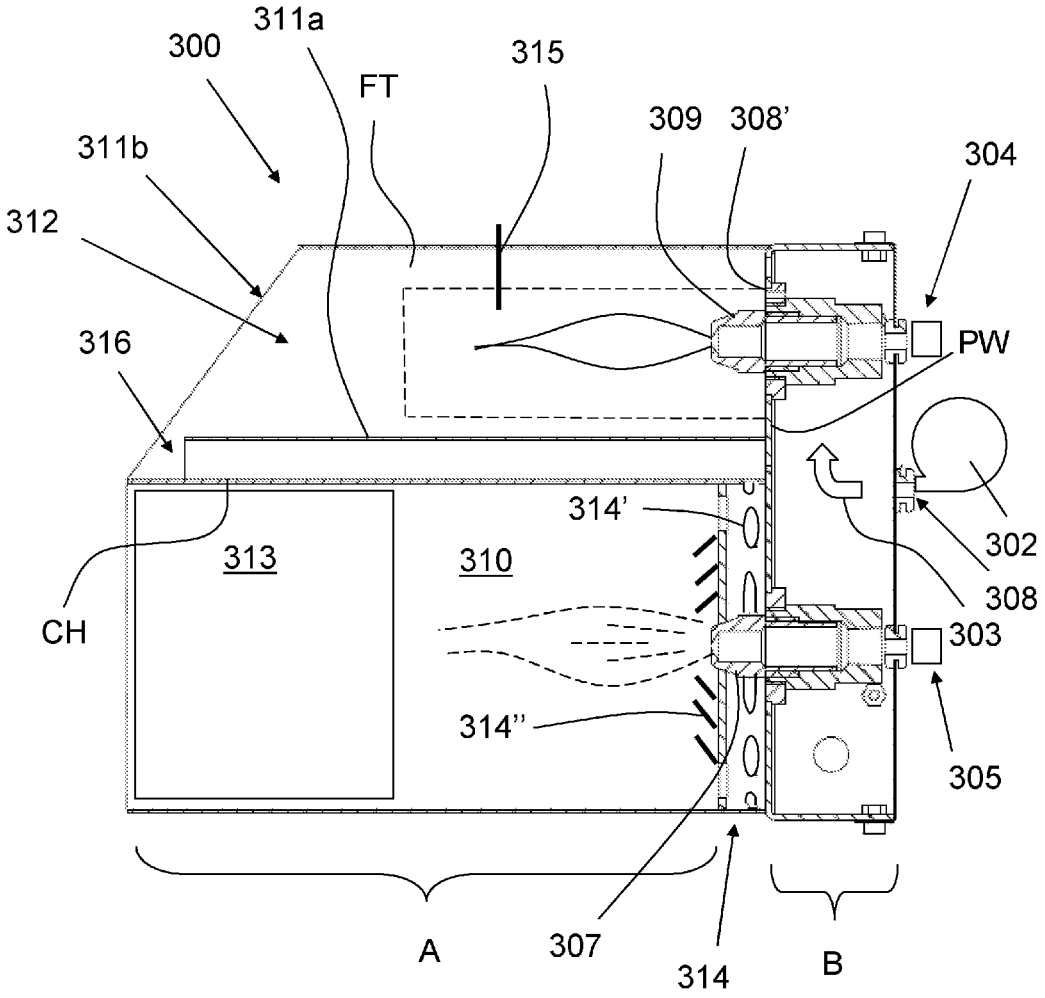
FIG. 3 illustrates an embodiment of the novel catalytic reactor.

In FIG. 3 a specific and preferred embodiment of the invention is illustrated. Thus, a catalytic combustor generally designated 300 is shown. It has the same general constitution as the schematically shown combustor of FIG. 2*b*, and similar features are given the same reference numerals as in FIG. 2*b*, but with the prefix "30". However, there are some specific details that enhances the operation of the apparatus.

In order to provide for the pre-heating of the catalytic burner necessary for achieving the required temperature in operation, there is a partition member 311*a* arranged at least partly around the circumference of the catalytic reaction chamber 310, as shown, although it could also extend entirely around the circumference. It is attached to the partition wall PW at one end and leaves a preferably circumferential slit 316 at the opposite end such that the hot gases generated in the pre-heating compartment 312 will flow along the outer surface of the reaction chamber and heat it.

In a particular embodiment there is a dedicated flame tube FT (shown in dotted lines), essentially having a circular cross-section, provided in the pre-heating chamber 312. It is attached to the partition wall PW such that it surrounds the atomizing nozzle 309. The flame tube is preferably of a circular cross-section, although this is not strictly necessary. The size and shape of the flame tube FT is such that the flame at the opening of the tube is optimized for the combustor at hand. It will be a matter of constructive testing pertaining to the field of the skilled man, without any need for inventive work to optimize the flame tube.

The operation of the reactor system according to the invention will now be described with reference to the embodiment shown in FIG. 3.

For the embodiment shown in FIG. 3, the combustor is optimized for several operations, start-up, pre-heating and normal operation—all designed to minimize emissions and to optimize performance.

The system is started by blowing air into the system, by the air fan 302 (shown schematically in FIG. 3), the air 303 enters the combustor through the orifice 308, and enters the control compartment B, and then the air passes through the partition wall PW via a nozzle 308' and further through the entire reactor system, before exiting the reactor at the end of the catalyst 313. Ignition is achieved by opening the secondary fuel valve, schematically indicated at 304, whereby the fuel is atomized and fed into the reactor by a fuel nozzle 309. Then the ignition electrode 315 is energized, by which sparks are formed in the atomized fuel/air mixture.

When ignition is achieved the air fan, is adjusted to provide optimal conditions for the flame combustion used in the pre-heating process. The warm gases produced from the flame combustion passes through the pre-heating chamber 312, around the flame shield 311 and into the catalytic mixing reactor chamber 310, through the turbulator 314, before passing over the catalyst 313.

In the shown embodiment the turbulator 314 consists of a plurality of oval orifices 314' arranged around the periphery of the tubular reaction chamber 310.

The air is transferred from the turbulator 314 into the reaction chamber by means of a swirler in order to achieve a homogeneous mixture between air and fuel. The swirler comprises deflection elements 314" arranged circumferentially around a fuel nozzle 307 in the reaction chamber 310.

By allowing the combustion gases to pass over the entire interior of the system it is possible to quickly transfer the heat from the combustion to the reactor system, while at the same time preventing soot formed when starting of the pre-heating process, to reach the catalyst, as this soot is collected on the distal wall 311*b* in the pre-heating chamber 312 and will be burned away as the pre-heating process reaches the operational temperature.

When the desired temperature has been reached in catalytic mixing chamber 310, the secondary fuel valve 304 is closed; the air is then adjusted to the normal catalytic operation mode and the primary fuel valve 305 is opened and atomized fuel is injected by the fuel nozzle 307, into the main mixing chamber 310.

The heat produced in the pre-heating process is transferred from the reactor walls to the incoming air and by so it is possible to vaporize the fuel by mixing the fuel with the preheated air and transport the air/fuel mixture to the catalyst 313.

When the vaporized air-fuel mixture comes in contact with the catalyst 313, the catalytic combustion process starts and heat is produced directly in the catalyst. The heat produced in the catalyst 313, is used to both maintain heat in the mixing chamber 310, during operation and primarily to provide heat to external applications.

By operating the catalytic combustion at high air-to fuel ratios it is possible to eliminate nitrous oxides (NOx), carbon monoxide (CO) and other hydrocarbon emissions from the heater as well as to increase the efficiency of the heater enabling the design of a clean heater for both automotive and other mobile and stationary applications.

The invention claimed is:

1. A catalytic heater, comprising:

a) a catalytic burner;

b) a reactor for operating catalytic combustion of liquid fuels;

c) a primary fuel supply arranged to supply fuel to the catalytic burner, said primary fuel supply being arranged in a catalytic reactor compartment; and d) a non-catalytic preheater arranged to preheat the catalytic burner, wherein the preheater and the primary fuel supply are provided in separate compartments including i) a preheater compartment, and ii) the catalytic reaction compartment, said preheater and catalytic reaction compartments being in heat transfer contact with each other, the preheater is arranged in the preheater compartment, a partition member being arranged along a perimeter of the catalytic reaction compartment, creating a channel having an inlet slit directly connected to the preheater compartment and an outlet opening directly connected to the catalytic reaction compartment at an end of the channel that is opposite of the inlet slit and near said primary fuel supply such that hot gases generated in the preheater compartment will flow through the channel, heating the catalytic reaction compartment.

2. The catalytic heater as claimed in claim 1, wherein the preheater comprises a preheating burner, having a first fuel atomizing nozzle and a secondary fuel supply for feeding fuel to the preheating burner.

3. The catalytic heater as claimed in claim 2, further comprising a flame tube arranged around the preheating burner.

4. The catalytic heater as claimed in claim 2, wherein the primary fuel supply comprises a second fuel atomizing nozzle.

5. The catalytic heater as claimed in claim 4, wherein the reaction chamber compartment is provided with a plurality of orifices arranged in the vicinity of the second fuel atomizing nozzle.

6. The catalytic heater as claimed in claim 1, further comprising an air inlet in the partition wall said inlet opening in to the pre-heating compartment.

7. The catalytic heater as claimed in claim 1, further comprising a catalyst bed in the reaction compartment at a distal end thereof.

8. The catalytic heater as claimed in claim 2, further comprising a flame tube arranged around the preheating burner.

9. The catalytic heater as claimed in claim 3, wherein the primary fuel supply comprises a second fuel atomizing nozzle.

10. The catalytic heater as claimed in claim 5, wherein the reaction chamber has a circular cross-section.

11. The catalytic heater as claimed in claim 5, wherein said openings are arranged circumferentially.

* * * * *